US008330751B2

(12) United States Patent
Ueno

(10) Patent No.: US 8,330,751 B2
(45) Date of Patent: Dec. 11, 2012

(54) DISPLAY APPARATUS INCLUDING PASSIVE MATRIX DISPLAY ELEMENT

(75) Inventor: Yuji Ueno, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 404 days.

(21) Appl. No.: 12/652,501

(22) Filed: Jan. 5, 2010

(65) Prior Publication Data

US 2010/0103154 A1 Apr. 29, 2010

Related U.S. Application Data

(63) Continuation of application No. PCT/JP2007/001500, filed on Dec. 28, 2007.

(51) Int. Cl.
*G09G 3/36* (2006.01)

(52) U.S. Cl. ..... 345/209; 348/751

(58) Field of Classification Search ..... 345/38, 345/50–54, 60–64, 87–104, 690; 348/751, 348/761, 766, 790
See application file for complete search history.

(56) References Cited

U.S. PATENT DOCUMENTS

| | | | | |
|---|---|---|---|---|
| 6,496,174 | B2 * | 12/2002 | Kurumisawa et al. | 345/98 |
| 6,950,086 | B2 * | 9/2005 | Nagai et al. | 345/95 |
| 6,961,036 | B2 * | 11/2005 | Chen et al. | 345/87 |
| 7,944,425 | B2 * | 5/2011 | Watanuki et al. | 345/94 |
| 2002/0018059 | A1 * | 2/2002 | Yanagi et al. | 345/204 |

FOREIGN PATENT DOCUMENTS

| | | |
|---|---|---|
| JP | A 1-213695 | 8/1989 |
| JP | A 2-212886 | 8/1990 |
| JP | A 4-62516 | 2/1992 |
| JP | A 7-159755 | 6/1995 |
| JP | A 11-38941 | 2/1999 |
| JP | A 2000-147466 | 5/2000 |
| JP | A 2000-171837 | 6/2000 |
| JP | A 2001-228459 | 8/2001 |
| JP | A 2007-304527 | 11/2007 |

OTHER PUBLICATIONS

Y-M. Zhu, et al., "Cumulative Drive Schemes for Bistable Reflective Cholesteric LCDs," SID 98 Digest, pp. 798-801, May 1998.
Japanese Office Action and partial English translation issued in Japanese Application No. 2009-547818 on May 22, 2012.

* cited by examiner

*Primary Examiner* — Amare Mengistu
*Assistant Examiner* — Vinh Lam
(74) *Attorney, Agent, or Firm* — Greer, Burns & Crain, Ltd.

(57) ABSTRACT

A display apparatus includes a passive matrix display element and can support full-color display. The apparatus includes a passive matrix display element 10 composed of a memory type display material, a row driver 26 for driving the scan electrode of the display element and a column driver 27 for driving the data electrode of the display element. A switching signal S/C is set to a segment mode during the falling period of a display-apparatus driving signal /DSPOF for preventing rush current caused at the falling edge of a frame signal FR. During this period, the former half of line data is transferred and outputted. Consequently, the falling period of the display-apparatus driving signal /DSPOF (i.e., time during which liquid crystal does not operate) can be shortened, thus improving the response characteristics of liquid crystal.

4 Claims, 22 Drawing Sheets

| COMMON | SEGMENT | POSITIVE POLARITY | NEGATIVE POLARITY |
|---|---|---|---|
| ON | ON | 20 | -20 |
| | OFF | 10 | -10 |
| OFF | ON | 5 | -5 |
| | OFF | -5 | 5 |

(V)

FIG. 8B

| /DSPOF | DATA LATCH SIGNAL | FR | DRIVER OUTPUT VOLTAGE | |
|---|---|---|---|---|
| HIGH | HIGH | HIGH | V0 | (SELECTION LEVEL) |
| | | LOW | V5 | |
| | LOW | HIGH | V21 | (NON-SELECTION LEVEL) |
| | | LOW | V34 | |
| LOW | - | - | V5 | - |

FIG. 10A

| /DSPOF | DATA LATCH SIGNAL | FR | DRIVER OUTPUT VOLTAGE | |
|---|---|---|---|---|
| HIGH | HIGH | HIGH | V5 | (SELECTION LEVEL) |
| | | LOW | V0 | |
| | LOW | HIGH | V21 | (NON-SELECTION LEVEL) |
| | | LOW | V34 | |
| LOW | - | - | V5 | - |

FIG. 10B

DISPLAY APPARATUS INCLUDING PASSIVE MATRIX DISPLAY ELEMENT

CROSS REFERENCE TO RELATED APPLICATION

This application is a continuation of PCT application of PCT/JP2007/001500, which was filed on Dec. 28, 2007.

FIELD

The invention relates to a display apparatus having a passive matrix display element, and more particularly to a display apparatus having a passive matrix display element which comprises a memory-property display material, such as a cohlesteric liquid crystal and the like, and is used for electronic paper and the like.

BACKGROUND

Recently, the development of electronic paper has been promoted in the industrial field, an educational foundation and the like. As application fields where electronic paper can be used, there are an electronic book, the monitor display apparatus of a mobile terminal set, etc., the display unit of an IC card, etc., and the like and various application forms are proposed and developed in each field. Furthermore, recently, newspaper information has been distributed on the Internet and electronic paper has been focused as an information medium instead of the conventional newspaper.

One leading method of electronic paper is a method using a cohlesteric liquid crystal and this uses the superior features of a cohlesteric liquid crystal, that is, characteristics of keeping semi-permanent display (memory-property), vivid color display, high contrast and high resolution.

Since the molecule of a cohlesteric liquid crystal forms a helical cohlesteric phase by adding fairly much (several-tens percentage of) chiral additive (chiral material) to a cohlesteric liquid crystal, such a cohlesteric liquid crystal is also called chiral nematic liquid crystal.

FIGS. 1A and 1B illustrate the state of a cohlesteric liquid crystal. As illustrated in FIGS. 1A and 1B, a display element 10 using a cohlesteric liquid crystal includes a top-side substrate 11, a cohlesteric liquid crystal layer 12 and a bottom-side substrate 13. The operational state of a cohlesteric liquid crystal includes a planer state capable of reflecting incident light as illustrated in FIG. 1A and a focal-conic state capable of transmitting incident light as illustrated in FIG. 1B. Both these states are maintained in a state where no voltage is applied, that is, under no electric field. Therefore, a cohlesteric liquid crystal can hold a stable display state.

When the operational state of a cohlesteric liquid crystal is a planer state, light of a wavelength corresponding to the helical pitch of the liquid crystal molecule is reflected. A wavelength $\lambda$ in which reflection becomes large can be expressed to be $n \cdot p$ ($\lambda = n \cdot p$) assuming that the average refractive index of a cohlesteric liquid crystal and its helical pitch are n and p, respectively.

Meanwhile, characteristically the reflection band $\Delta\lambda$ of a cohlesteric liquid crystal widely varies depending on the refractive index anisotropy $\Delta n$ of the liquid crystal.

When the operational state of a cohlesteric liquid crystal is a planer state, it becomes a "light" state because of reflection of incident light, that is, a state capable of displaying white. Meanwhile, when the operational state of a cohlesteric liquid crystal is a focal-conic state, it becomes a "dark" state, that is, a state capable of displaying black. That is because when a light absorptive layer is provided under the bottom-side substrate 13, light transmits through a liquid crystal layer and also it is absorbed by the light absorptive layer.

The driving method of a conventional general display element using a cohlesteric liquid crystal will be explained below.

FIG. 2 is a graph illustrating the voltage-reflectance characteristic of a conventional general cohlesteric liquid crystal.

In the graph illustrated in FIG. 2, the vertical and horizontal axes of the graph indicate the reflectance (%) of a cohlesteric liquid crystal and the voltage value (V) of a pulse voltage applied to between electrodes pinching a cohlesteric liquid crystal with a predetermined pulse width, respectively.

A curve P indicated by a solid line indicates the voltage-reflectance characteristic of a cohlesteric liquid crystal whose initial state is a planer state and a curve FC indicated by a broken line indicates the voltage-reflectance characteristic of a cohlesteric liquid crystal whose initial state is a focal-conic state where incident light is transmitted.

When a relatively intense electric field is generated in the cohlesteric liquid crystal by applying a predetermined high voltage VP100 (for example, ±36V) to between electrodes pinching the cohlesteric liquid crystal, the helical structure of the cohlesteric liquid crystal is completely released and it moves to a homeotropical state where all molecules follow the direction of the electric field.

When the electric field in the cohlesteric liquid crystal is suddenly reduced to almost zero by suddenly reducing an applied voltage from VP100 to a predetermined low voltage (for example, VF0=±4V) while the molecules of the crystal liquid is in a homeotropical state, the helical axis of the cohlesteric liquid crystal becomes perpendicular to the electrode and transits to a planer state where light corresponding to the helical pitch is selectively reflected.

Meanwhile, a relatively weak electric field is generated in the cohlesteric liquid crystal by applying a predetermined low voltage VF100*b* (for example, ±24V), it enters a state where the helical structure of the cohlesteric liquid crystal molecule is not completely released. When the electric field in the liquid crystal is suddenly reduced to almost zero by suddenly reducing the applied voltage from VF100*b* to low voltage VF0 in this state or when the electric field is slowly eliminated by applying an intense electric field, the helical axis of the liquid crystal molecule becomes parallel to the electrode, namely, it enters the above-described focal-conic state where the incident light is transmitted.

When the electric field is suddenly eliminated by applying an intermediately intense electric field, gradation display becomes possible since the above-described planer state where the incident light is reflected and the above-described focal-conic state where the incident light is transmitted are mixed. Conventionally, a liquid crystal display apparatus displays images by using reflective and absorptive functions of the incident light, as described above.

The principle of the driving method based on the above-described voltage response characteristic will be explained in more detail with reference to FIGS. 3A through 3C.

FIG. 3A illustrates a pulse response characteristic in the case where the pulse width of a voltage pulse is several tens ms in the cohlesteric liquid crystal, FIG. 3B illustrates a pulse response characteristic in the case where the pulse width of a voltage pulse is 2 ms and FIG. 3C illustrates a pulse response characteristic in the case where the pulse width of a voltage pulse is 1 ms in the cohlesteric liquid crystal. A voltage pulse applied to the cohlesteric liquid crystal is indicated on the top-side of each of FIGS. 3A through 3C and a voltage-reflectance characteristic on the bottom side. The vertical and horizontal axes of FIGS. 3A through 3C indicate a reflectance (%) and a voltage (V), respectively. For the drive pulse of the cohlesteric liquid crystal, a combination of positive and negative pulses is used. As well known, when a fixed pulse whose polarity is not inverted continues to be applied to the cohlesteric liquid crystal, the degradation of the cohlesteric liquid crystal, due to polarization is induced. However, such degradation can be prevented by using a combination of positive and negative pulses.

In FIG. 3A, when the pulse width of a voltage pulse applied to the cohlesteric liquid crystal is as large as several tens ms, in the case where the initial state is a planer state, it enters a focal-conic state when the voltage is increased to a certain level, as illustrated by a solid line, and it returns to a plenary state when the voltage is further increased. However, as illustrated by a broken line, in the case where the initial state is a planer state, it gradually transits to a planer state as the pulse voltage is increased.

When the pulse width of a voltage applied to the cohlesteric liquid crystal is large, the pulse voltage in which it always enters a planer state regardless of whether it is either a planer or focal-conic state is ±36V in FIG. 3A. When an intermediate pulse voltage is applied, gradation display can be obtained since planer and focal-conic states are mixed in the cohlesteric liquid crystal.

Meanwhile, when the pulse width of a voltage pulse applied to the cohlesteric liquid crystal is as small as 2 ms, as illustrated in FIG. 3B, in the case where the initial state is a planer state, the reflectance does not change when the pulse voltage is 10V. Since planer and focal-conic states are mixed when the pulse voltage is more than 10V, the reflectance degrades. This amount of degradation of the reflectance increases as the applied voltage increases. However, when the applied voltage becomes more than 36V, the amount of degradation of the reflectance becomes constant. Such a characteristic in the cohlesteric liquid crystal also applies to a state where planer and focal-conic states are mixed in the initial state. Therefore, when in the case where the initial state is a planer state, the pulse width is 2 ms and the voltage pulse whose pulse voltage is 20V is applied once, the reflective index degrades somewhat. Therefore, in a state where planer and focal-conic states are mixed (that is, a state where the reflectance degrades somewhat), the pulse width of the voltage pulse is 2 ms and also the reflectance of the cohlesteric liquid crystal can be further degraded by further applying the voltage pulse whose pulse voltage is 20V. The reflectance can be degraded to a predetermined value by repeating the sequence of the above operations.

As illustrated in FIG. 3C, when the pulse width further decreases to 1 ms, as in the case where the pulse width is 2 ms, the reflectance of the cohlesteric liquid crystal can be further degraded by further applying the voltage pulse to the cohlesteric liquid crystal. In this case, the degradation rate of the reflectance becomes smaller than that in the case where the pulse width is 2 ms.

Judging from the above, if a pulse of 36V is applied with a pulse width of several tens ms, the cohlesteric liquid crystal enters a planer state. If a pulse of between ten several V and 20V is applied, it enters a state where planer and focal-conic states are mixed and the reflectance degrades. This amount of degradation of the reflectance relates to the accumulation time of the pulse.

Currently, various driving method for realizing multi-gradation display using the cohlesteric liquid crystal are proposed and developed. These can be roughly classified into two of a dynamic driving method (for example, see document 1) and a conventional driving method (see Non-patent document 1).

Since the drive waveform of the dynamic driving method is complex, the dynamic driving method requires a complex control circuit and a driver IC and also requires a low-resistance transparent panel electrode. Therefore, the manufacturing cost becomes high. Furthermore, the power consumption is also large.

Non-patent document 1 discloses the conventional driving method of gradually driving the cohlesteric liquid crystal from a planer state to a focal-conic state or from a focal-conic state to a planer state, at the fairly high speed of a semi-moving image rate by adjusting the application times of a short voltage pulse, using an accumulation time peculiar to the cohlesteric liquid crystal.

In the driving method disclosed in Non-patent document 1, since the driving speed is at the high speed of a semi-moving image rate, the driving voltage is set to 50 through 70V. Therefore, the cost of the circuit becomes high. Furthermore, in the "two phase cumulative drive scheme" described in Non-patent document 1, accumulation times in two ways of an accumulation time to a planer state and an accumulation time to a focal-conic state are used by using two stages of a "preparation phase" and a "selection phase". Therefore, the display quality of display images cannot be improved. Furthermore, since a fine voltage pulse is frequently applied, the power consumption of the driver circuit becomes large.

Patent documents 2 and 3 disclose a fast-forward mode driving method based on the reset to a focal-conic state. In this driving method, fairly high contrast can be obtained compared with the above-described driving method. However, in the case of a general-purpose STN driver IC, since writing after the reset requires a supply-difficult high voltage and also becomes cumulative writing in which it is transited in the direction of a planer state, cross-talk to a semi-selected/non-selected pixel becomes a problem. Besides, since a fine pulse is frequently applied in this driving method too, the power consumption becomes large.

When gradation is set using an accumulation time in the conventional driving method, the differentiation of a pulse width is also possible in addition to the adjustment of application times of a short pulse as described above. Thus, the differentiation of a pulse width is effective in suppressing the power consumption than the adjustment of application times of a short pulse. In the following explanation, a method for and differentiating a pulse width and setting gradation by changing an accumulation time is called PWM (pulse width modulation).

Patent document 4 discloses the circuit composition of a method for applying positive and negative pulses, whose pulse widths are different, to a liquid crystal display as a pulse voltage although no cohlesteric liquid crystal is used.

Each of FIGS. 4A through 4C illustrates one example of a voltage pulse whose width is different disclosed in Patent document 4. In these examples, the pulse width is made longer in the descending order of FIGS. 4A, 4B and 4C.

The voltage pulses illustrated in FIGS. 4A through 4C have positive and negative pulses whose per unit pulse length are the same and whose widths are different. The degradation due to the polarization of the cohlesteric liquid crystal can be prevented by applying such a polarity-conversion voltage pulse.

As described above, as methods for differentiating gradation by differentiating the application cumulative time of a voltage pulse applied to the cohlesteric liquid crystal, a method for differentiating the application times of a short voltage pulse and a method for differentiating the width of an applied voltage pulse (PWM method) are well known.

In the method differentiating gradation by differentiating the application cumulative time of a voltage pulse applied to the cohlesteric liquid crystal, voltages as illustrated in FIGS. 3B and 3C are applied. In the method for differentiating the application times of a short voltage pulse, a voltage as illustrated in FIG. 5 is applied to a pixel.

In the cohlesteric liquid crystal, when a large voltage is applied, the state changes regardless of the polarity of the applied voltage. In the liquid crystal display apparatus using the cohlesteric liquid crystal, a scan line extending in the horizontal direction is written one by one and the shifting operation of a written scan line is repeated. Therefore, a voltage at a ground level and an intermediate voltage (for example, 15V) are applied to a selected scan line and other non-selected scan lines, respectively. Meanwhile, although a pulse of a large voltage (20V) is applied to a data line extending in the vertical direction. In this case, if the potential of parts other than the pulse width is assumed to be ground potential (GND), a large voltage in inverse polarity (−15V) is applied to a pixel in the non-selected scan line and the state of the cohlesteric liquid crystal changes.

In order to prevent such a state change of the liquid crystal, in the case of a liquid crystal display apparatus using the cohlesteric liquid crystal, as illustrated in FIG. 5, a base voltage of +10V and a pulse voltage of +20V are used in a positive-polar phase, and a base voltage of −10V and a pulse voltage of −20V are used in a negative phase. Thus, either +5V or −5V is applied to the pixel of a non-selected scan line and there is no change in the state of the liquid crystal. In a selected scan line, either +20V or −20V is applied to a pulse part and either +10V or −10V is applied to a base part other than it.

Furthermore, Patent document 5 intends to realize a liquid crystal display circuit capable of supporting various types and forms of liquid crystal display panels and discloses a liquid crystal display circuit including a plurality of segment/common switching circuit composed of a first switching circuit for switching according to a common setting signal between a start signal for setting a common signal by shifting one pulse and storage data for switching over to either "common" or "segment", a flip-flop circuit operated by the output of this first switching circuit, a reset pulse signal and a common clock and a second switching circuit for switching the output of this flip-flop circuit by the above-described common setting signal.

Patent document 1: Japanese Laid-open Patent Publication No. 2001-228459

Patent document 2: Japanese Laid-open Patent Publication No. 2000-147466

Patent document 3: Japanese Laid-open Patent Publication No. 2000-171837

Patent document 4: Japanese Laid-open Patent Publication No. H4-62516

Patent document 5: Japanese Laid-open Patent Publication No. H11-38941

Non-patent document 1: Y. M. Zhu, D. K. Yang, "Cumulative Drive Schemes for Bistable Reflective Cohlesteric LCDs.", SID 98 DIGEST, pp 781-801 (1998)

The display apparatus including the above-described passive matrix display element transfers and outputs data when the operation mode of the driver is in a segment mode. Then, by changing the operation mode of the driver to a common mode at once, it outputs the data transferred in the segment mode in a common mode. Furthermore, since the data is transferred when the operation mode of the driver is a segment mode and during this period the data is not outputted as in a common mode, the output of the driver is switched off in a segment mode. In such a driving method, since only data is transferred at the time of data transfer in a segment mode and the liquid crystal is not driven, it affects the response speed of the liquid crystal.

In the present invention, it is a problem to shorten this data transfer time and to improve the response speed of the liquid crystal.

This problem will be explained in more detail below.

FIG. 12 is a time chart illustrating the sequence of the output signal of a general passive matrix driver.

In FIG. 12, a pulse signal XCLK indicates a clock for retrieving data (see FIG. 6). A pulse signal LP indicates a latch pulse for data confirmation. A frame signal FR repeating cyclic rise and fall indicates a pulse polarity conversion control signal for recovering time-varying degradation peculiar to liquid crystal by inverting the polarity of the applied voltage. A switching signal S/C indicates a signal for switching over between segment and common modes. A display apparatus driving signal /DSPOF (DSPOF bar) is the drive signal of a liquid crystal display apparatus and more particularly it indicates the inverse signal of a compulsory off signal of the applied voltage (signal for switching off the applied voltage, that is, the signal DSPOF illustrated in FIG. 6). Furthermore, an OUT voltage is a voltage applied to the liquid crystal display in order to output (display) line data.

As illustrated in FIG. 12, when the switching signal S/C is on the segment side and the driver is in the segment mode, the conventional liquid crystal display apparatus (display apparatus including a passive matrix display element) transfers and outputs data. Then, when the switching signal S/C is switched over to the common side and the operation mode of the driver is instantaneously changed to the common mode, the data transferred to the liquid crystal in the segment mode is outputted (displayed) in the common mode. This output (display) is performed by applying an OUT voltage to the liquid crystal. Since when the driver is in the segment mode data is transferred and during this period data is not outputted as in the common mode, the output of the driver is compulsorily stopped by switching off the display apparatus driving signal /DSPOF (DSPOF bar) in the segment mode. As described above, in such a driving method, only data transfer is performed at the time of data transfer in the segment mode and the liquid crystal is not driven, thereby affecting the response speed of the liquid crystal. Such control for compulsorily stopping the output of the driver by switching off the display apparatus driving signal /DSPOF (DSPOF bar) also applies to at the falling time of the frame signal FR for inverting the polarity of an applied voltage. Since at this moment large current accompanies, by compulsorily stopping the output of the driver, rush current is prevented and voltage drop is suppressed.

SUMMARY

It is an object of the present invention to provide a display apparatus including a passive matrix display element whose data transfer time can be shortened by modifying the sequence of control signals outputted by the driver circuit and which improves the response function of the liquid crystal, in order to solve the above-described problem of the drive control unit of a passive matrix cohlesteric liquid crystal display element.

In order to attain the above-described purpose, the display apparatus of the present invention includes a matrix display element, a row driver for driving the scan electrode of the display element and a column driver for driving the data electrode of the display element. It further includes a unit for outputting control signals composed of a pulse signal XCLK being a clock for retrieving data, a pulse signal LP being a latch pulse for data confirmation, a frame pulse FR being a pulse polarity control signal for preventing the degradation of liquid crystal and a signal /DISPOF for specifying a display apparatus driving stoppage period, a unit for outputting a switching signal S/C for specifying either a segment mode capable of transferring display data or a common mode for applying a voltage to the liquid crystal and outputting the transferred display data, a unit for switching over the segment mode capable of transferring display data during the display apparatus driving stoppage period set by the signal /DISPOF for preventing rush current into the liquid crystal caused at the falling time of the frame signal FR and a unit for transferring part of the display data during the period in which a mode is switched over to the segment mode.

By such a configuration, the falling period of the display apparatus driving signal /DSPOF (DSPOF bar) (that is, display apparatus driving stoppage period) of the data transfer period can be shortened than before. Thus, since a time during which the liquid crystal does not operate is reduced, the response characteristic of the liquid crystal is can be improved.

Furthermore, in the display apparatus, part of the display data transferred while the driver is switched over to the segment mode is the former half of the display data.

By such a configuration, the falling period of the display apparatus driving signal /DSPOF (DSPOF bar) (that is, display apparatus driving stoppage period) of the data transfer period can be shortened to approximately the half of conventional one. Thus, since a time during which the liquid crystal does not operate is reduced, the response characteristic of the liquid crystal can be improved.

Furthermore, in the display apparatus, all of the control signal, the switching signal S/C and the output signals of the display data are inputted to a liquid crystal display panel supporting full-color display.

Furthermore, in the display apparatus, the liquid crystal display panel supporting full-color display includes three layers of liquid crystal panels corresponding to red, green and blue colors.

BRIEF DESCRIPTION OF THE DRAWINGS

FIG. 8B illustrates a voltage applied to a liquid crystal with the output pulse illustrated in FIG. 8A;

FIG. 10A illustrates the output voltage in the segment mode of a general-purpose passive matrix driver;

FIG. 10B illustrates the output voltage in the common mode of a general-purpose passive matrix driver;

DESCRIPTION OF EMBODIMENT

The embodiments of the present invention will be explained below with reference to the drawings.

Figure 1:
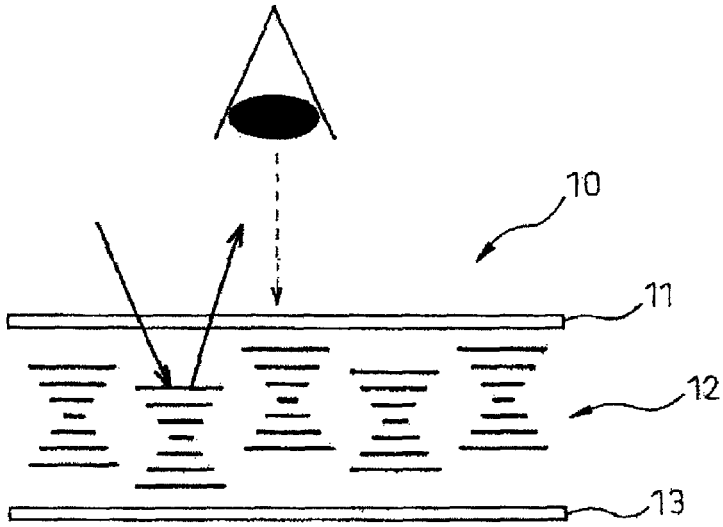
F I G. 1 A (PRIOR ART)
FIG. 1A illustrates the planer state of a cohlesteric liquid crystal.
FIG. 1B illustrates the focal-conic state of a cohlesteric liquid crystal.
Figure 1:
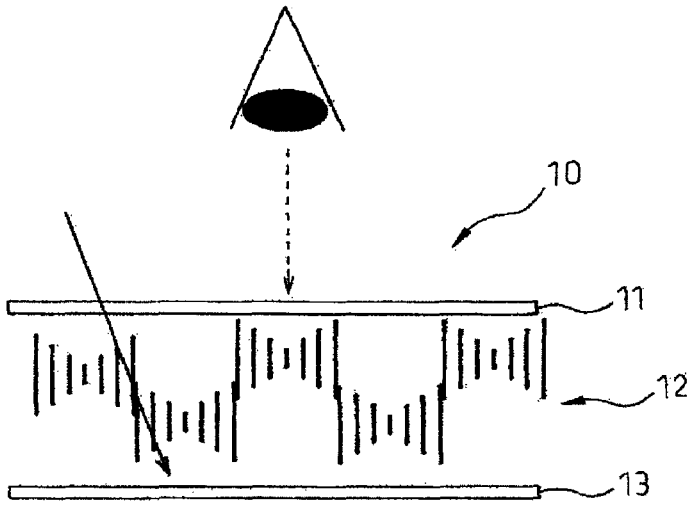
F I G. 1 B (PRIOR ART)
Figure 2:
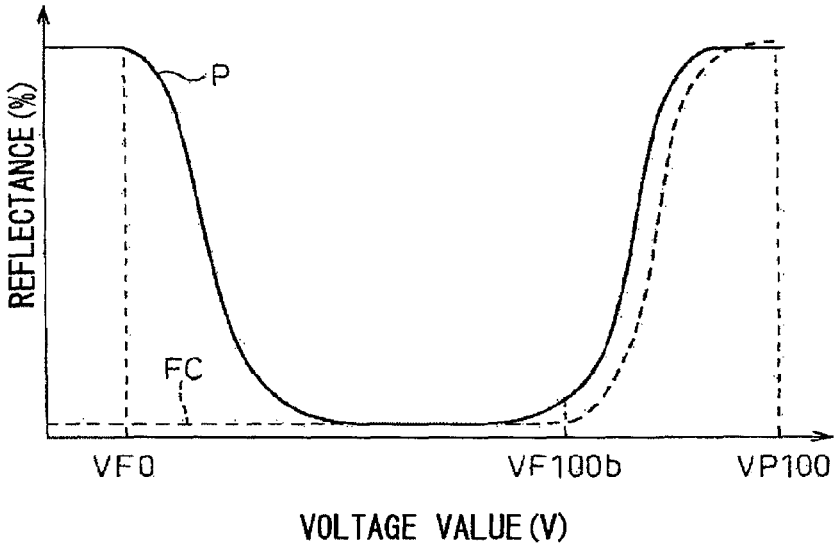
F I G. 2 (PRIOR ART)
FIG. 2 is a graph illustrating the voltage-reflectance characteristic of a conventional general cohlesteric liquid crystal.
Figure 3:
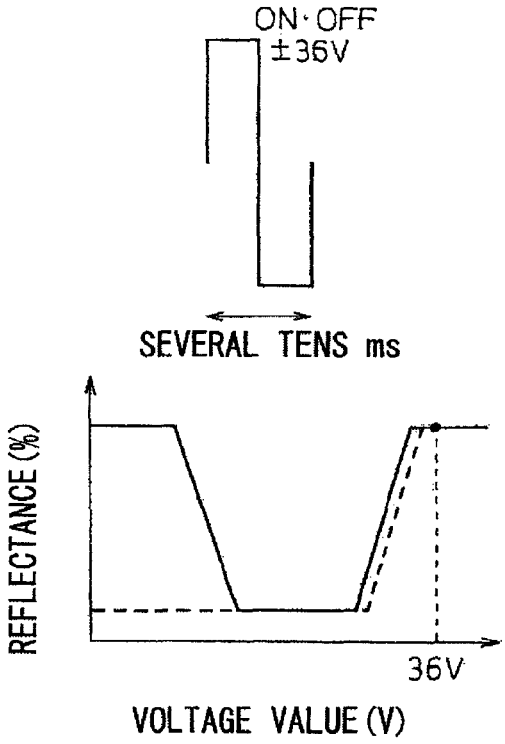
F I G. 3 A (PRIOR ART)
FIG. 3A illustrates the change of a reflectance, by a large voltage applied to a cohlesteric liquid crystal and its broad pulse.
FIG. 3B illustrates the change of a reflectance, by an intermediate voltage applied to a cohlesteric liquid crystal and its narrow pulse.
FIG. 3C illustrates the change of a reflectance, by an intermediate voltage applied to a cohlesteric liquid crystal and its narrower pulse.
Figure 3:
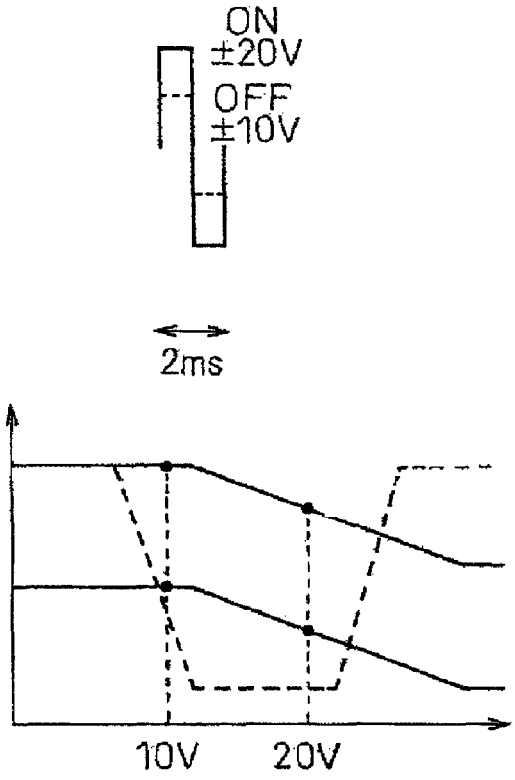
F I G. 3 B (PRIOR ART)
Figure 3:
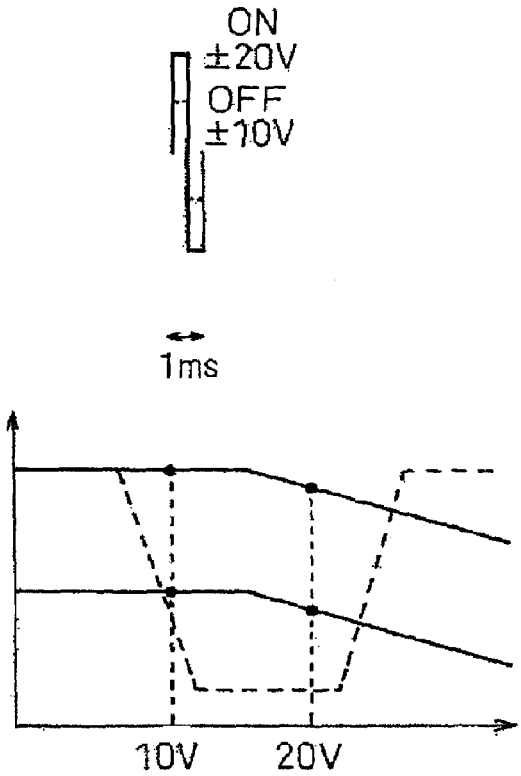
F I G. 3 C (PRIOR ART)
Figure 4:
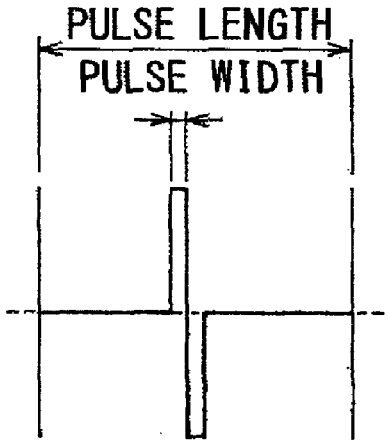
F I G. 4 A (PRIOR ART)
FIG. 4A is a waveform illustrating one example of the case where a symmetrical pulse applied to a liquid crystal is narrow.
FIG. 4B is a waveform illustrating one example of the case where a symmetrical pulse applied to a liquid crystal is intermediate.
FIG. 4C is a waveform illustrating one example of the case where a symmetrical pulse applied to a liquid crystal is broad.
Figure 4:
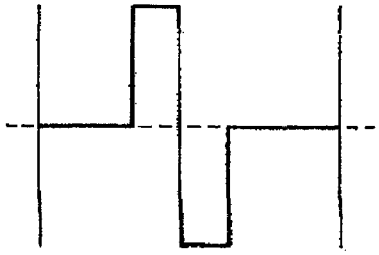
F I G. 4 B (PRIOR ART)
Figure 4C:
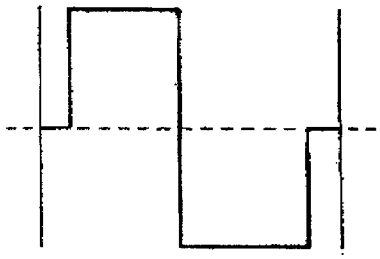
FIG. 4C (PRIOR ART)
Figure 5:
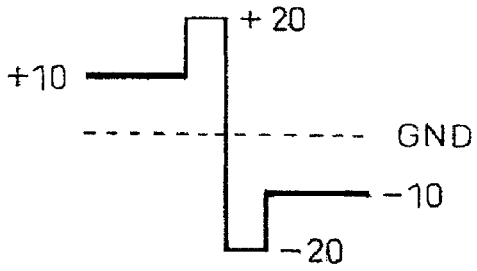
FIG. 5 (PRIOR ART)
FIG. 5 is a waveform illustrating one example of a symmetrical pulse applied to a cohlesteric liquid crystal.
Figure 6:
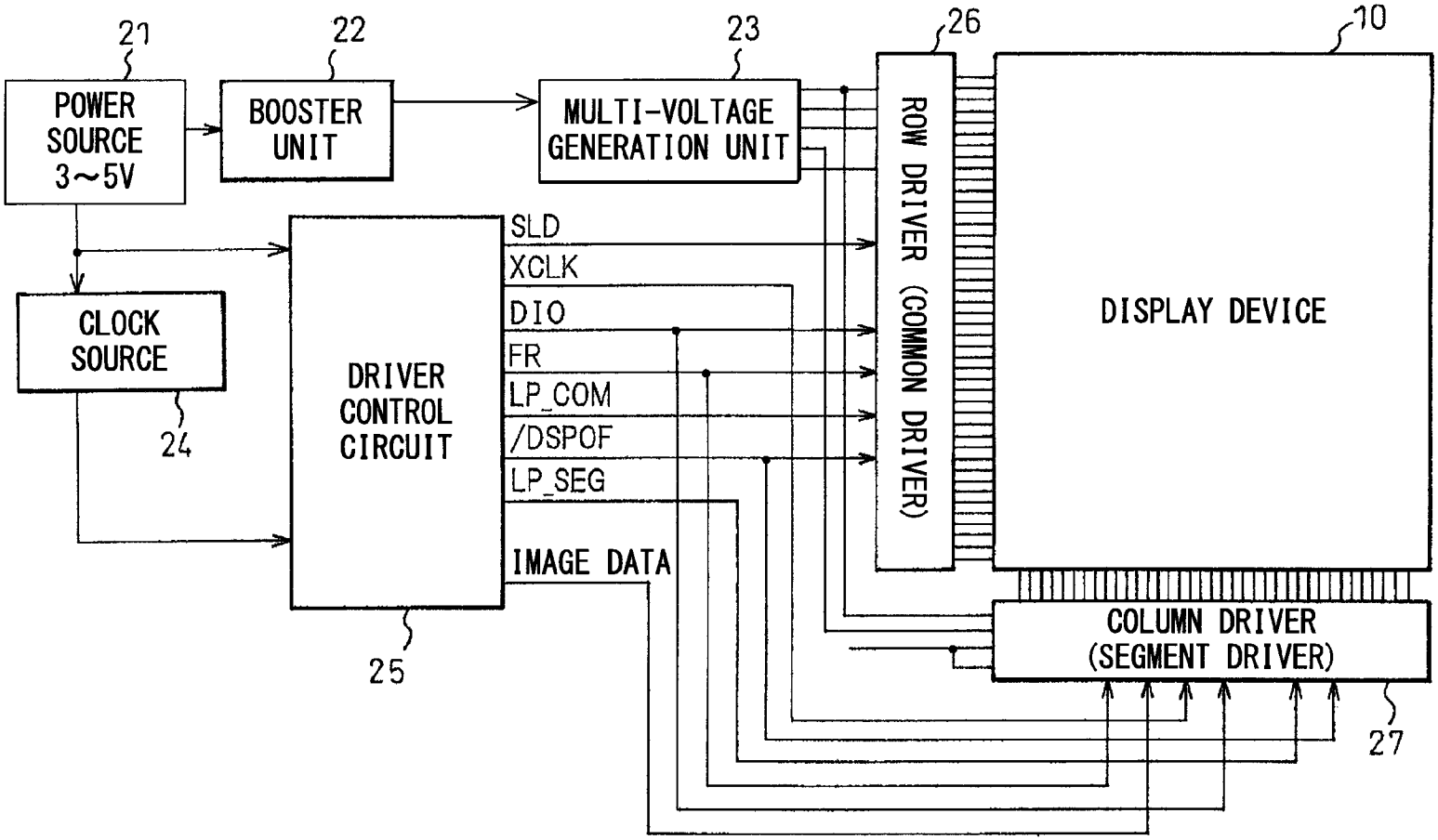
FIG. 6 is a schematic configuration of a display apparatus according to the embodiment of the present invention.

FIG. 6 is a schematic configuration of a display apparatus according to the embodiment of the invention.

A display according to the embodiment includes a passive matrix display element 10 composed of memory display material, such as a cohlesteric liquid crystal and the like, a power source 21 for supplying power to a circuit, a booster unit 22 for boosting the output voltage of the power source 21, a multi-voltage generation unit 23 for branching the output of the booster unit 22 into a plurality of voltage values, a clock source 24 for supplying clocks to a circuit, a driver control circuit 25 for generating a plurality of control signals and image data, a row driver 26 (common driver) for driving a scan line and a column driver 27 (segment driver) for driving a display line.

The operation of a display apparatus according to the embodiment will be explained below.

The display element 10 can be, for example, specified as A4·XGA and have 1024×768 pixels. The power source 21 can output voltage of, for example, 3-5V. The booster unit 22 boosts voltage inputted from the power source 21 up to 36-40V by a regulator, such as a DC-DC converter. The multi-voltage generation unit 23 generates a plurality of voltages supplied from a boosted voltage to the row driver (common driver) 26 and column driver (segment driver) 27.

The clock source 24 outputs clocks used to control each unit of this display apparatus. The driver control circuit 25 outputs a plural types of control signals and controls both the row driver 26 and column driver 27.

Scan line data SLD is latched and sequentially shifted by the row driver 26. A data retrieving clock XCLK is used for the column driver 27 to transfer image data inside.

A frame start signal DIO is a signal to instruct the update of a display line. A pulse polarity control signal FR is a polarity inverted signal of applied voltage.

A scan shift signal LP_COM is a signal to instruct the update of a display line in the row driver 26.

A signal /DSPOF (DSPOF bar) indicates the drive signal of a liquid crystal display apparatus and more particularly is the inverse signal of the compulsory off signal of applied voltage (signal for switching off applied voltage, more specifically, signal DSPOF). A column data latch signal LP_SEG is a signal to instruct the update of a display line in the column driver 27. Image data is inputted to the column driver 27.

The row driver (common driver) 26 drives 768 scan lines and the column driver (segment driver) 27 drives 1024 data lines. Since a different piece of image data is given to each pixel of RGB, the column driver 27 independently drives each data line. The row driver 26 commonly drives lines of RGB. For each of the row driver (common driver) 26 and column driver (segment driver) 27, a general-purpose two-valued output passive matrix driver is used. A widely used driver IC includes a common driver IC and a segment driver IC. Furthermore, the driver IC can be use as both the common and segment drivers, depending on voltage applied to a mode switching terminal.

Figure 7:
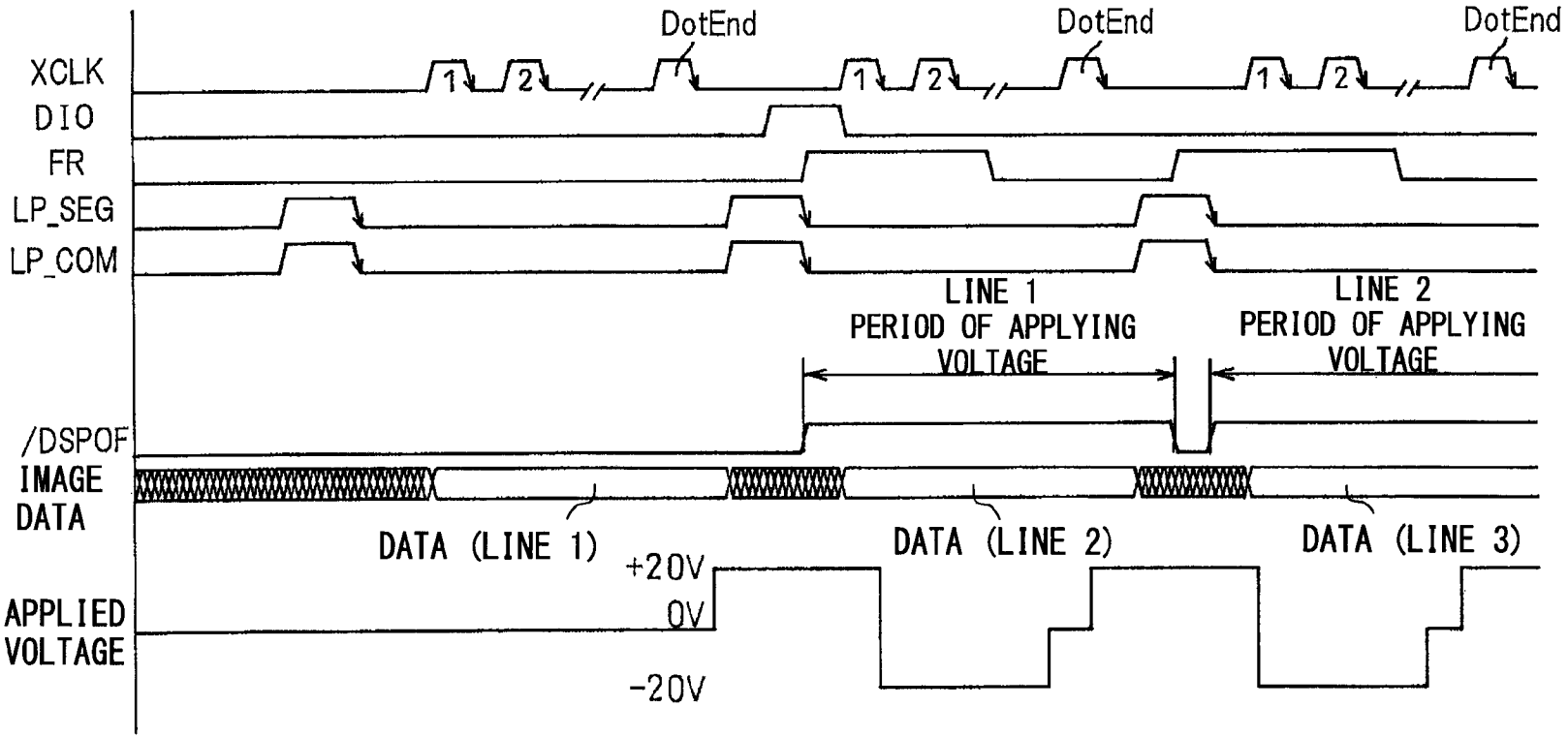
FIG. 7 is a time chart illustrating one example of the drive sequence of a display apparatus according to the embodiment of the present invention.

FIG. 7 is a time chart illustrating one example of the drive sequence of a display apparatus according to the embodiment of the present invention.

As illustrated in FIG. 7, data of one line is supplied to the column driver 27 according to the data retrieving clock XCLK after a display line is updated by applying the control signals LP_COM and LP_SEG to a liquid crystal, and the control signals LP_COM and LP_SEG are applied to the liquid crystal again when pixel data of one line is arranged by shifting 1024 pieces of pixel data. Then, the row driver 26 outputs a voltage pulse having a positive phase to one scan line. The column driver 27 outputs a voltage pulse having a positive phase corresponding to image data of one line data to 1024 data lines.

After the application of a pulse having a positive phase is completed, a voltage pulse having a negative phase is applied to the liquid crystal. In parallel with this, as described above, pixel data of one subsequent line is supplied.

Then, by repeating the same process, voltage pulses having positive and negative phases are applied to the full screen according to display data. If a pulse cumulative application time corresponding to a gradation gray level is adjusted by the number of voltage pulses applied to the liquid crystal, the times of voltage pulses applied for each data line is changed. If the pulse cumulative application time is adjusted by the pulse length, the width of a voltage pulse applied to the liquid crystal for each data line is changed.

When all pixels are reset to a planer state, high (for example, 36V) symmetrical voltage broad pulses having positive and negative phases are applied to all pixels of the liquid crystal.

Figure 8A:
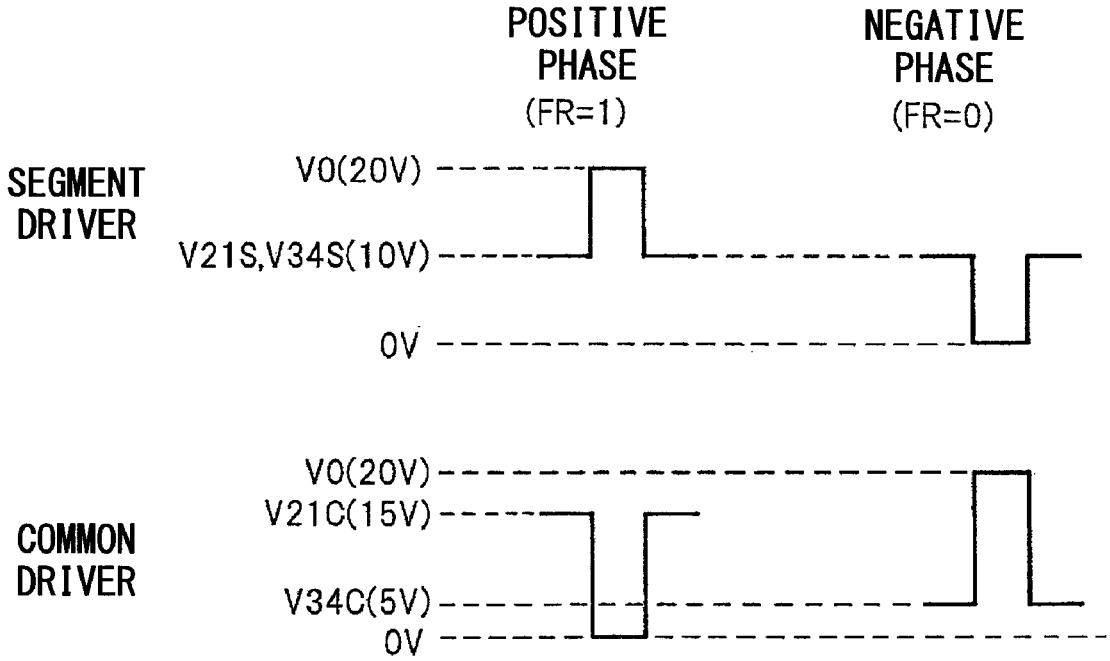
FIG. 8A is a time chart illustrating one example of the output pulse sequence of a general-purpose segment driver and a general-purpose common driver in a display apparatus.

In a display apparatus using a cohlesteric liquid crystal, the column driver (segment driver) and the row driver (common driver) output, for example, pulses illustrated in FIG. 8A as gradation pulses applied to change the planer state to a half-tone gradation gray level. By applying such pulses, voltages illustrated in FIG. 8B are applied to a pixel.

20V and 10V are supplied to the column driver as V0 and V21S & V34S, respectively, and as illustrated in FIG. 8A, positive and negative pulses are outputted in a positive phase (FR=1) and a negative phase (FR=0), respectively.

20V, 15V and 5V are supplied to the row driver as V0, V21C and V34C, respectively, and as illustrated in FIG. 8A, negative and positive pulses are outputted in a positive phase (FR=1) and a negative phase (FR=0), respectively.

By applying the pulses as illustrated in FIG. 8A, if a scan line is selected (a common driver is on) and also a data line is selected (a segment driver is on), 20V and −20V are applied in a positive phase (FR=1) and a negative phase (FR=0), respectively. If a scan line is selected (a common driver is on) and a data line is not selected (a segment driver is off), 10V and −10V are applied in a positive phase (FR=1) and a negative phase (FR=0), respectively. If a scan line is not selected (a common driver is off) and a data line is selected (a segment driver is on), 5V and −5V are applied in a positive phase (FR=1) and a negative phase (FR=0), respectively. If a scan line is not selected (a common driver is off) and also a data line is not selected (a segment driver is off), −5V and 5V are applied in a positive phase (FR=1) and a negative phase (FR=0), respectively. The row driver (FIG. 6) and common driver of this display apparatus can be composed of a general-purpose passive matrix driver IC. As the general-purpose passive matrix driver IC, an IC in which it can be selected as which it is used, a segment driver or a common driver depending to a voltage level applied to a terminal is also developed in addition to the segment and common driver ICs (For example, Seiko Epson-make STN liquid crystal driver S1D17A03/S1D17A04).

Figure 9:
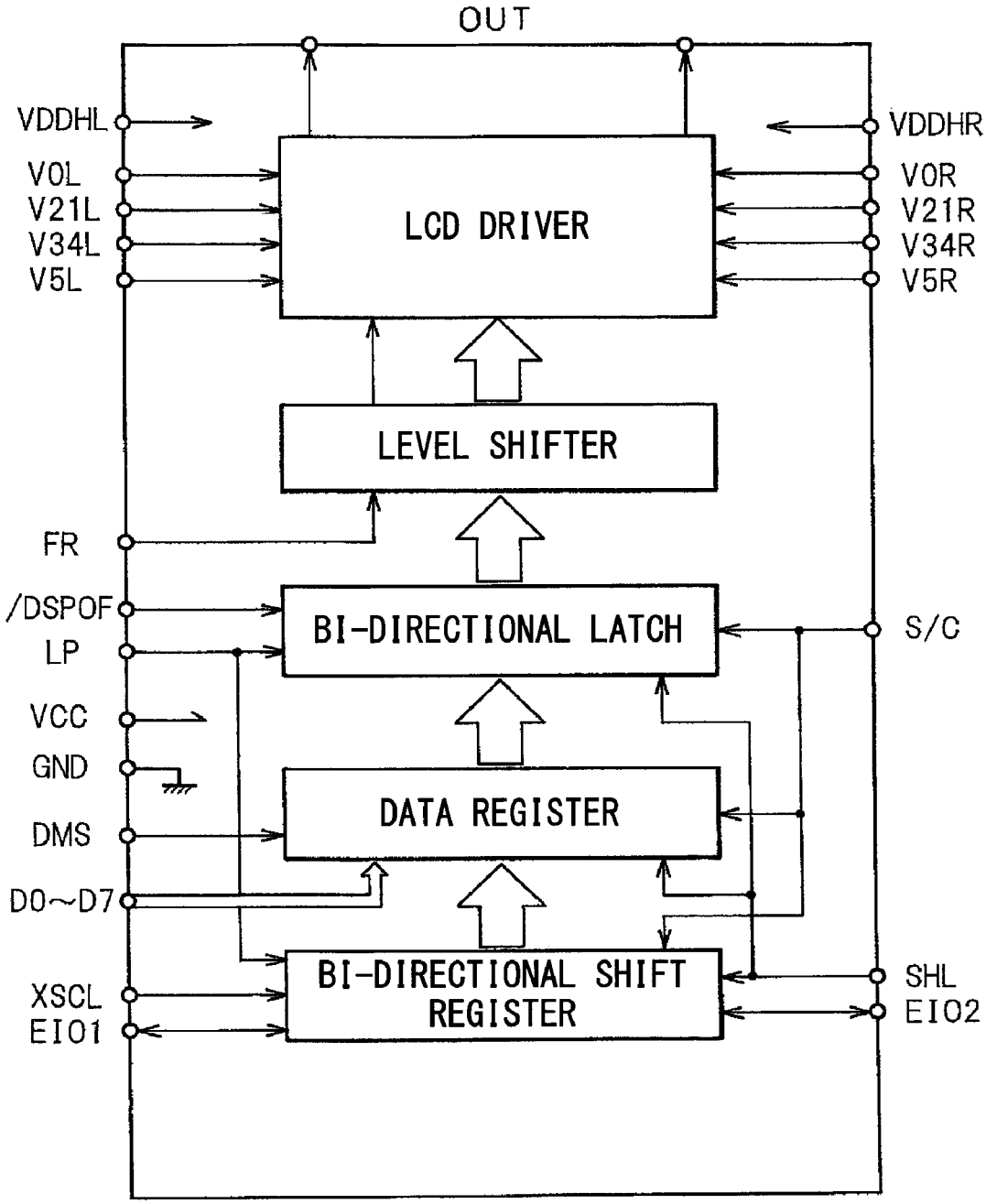
FIG. 9 is a configuration of a general-purpose passive matrix driver.

FIG. 9 illustrates a block configuration of a passive matrix driver IC with a mode selection function to select as which it is used, a segment driver or a common driver and its input/output signals.

Since this driver IC is used as both segment and common drivers, it includes a shift register, a data register and a latch.

FIG. 10A illustrates the relationship between an input signal and an output voltage in the segment mode of the passive matrix driver IC with a mode selection function illustrated in FIG. 9.

As illustrated in FIG. 10A, if the display apparatus drive signal /DSPOF is "high (HIGH: 1)", the driver in a segment mode outputs according to a data latch signal and if the display apparatus drive signal /DSPOF is "low (LOW: 0)", the output becomes a predetermined value V5 (for example, GND). If the data latch signal is "1" and also the polarity control signal FR is "1", it outputs V0 (20V) and if the data latch signal is "1" and the polarity control signal FR is "0", it outputs the ground level V5 (GND). If the data latch signal is "0" and the polarity control signal FR is "1", it outputs V21 (10V) and if the data latch signal is "0" and the polarity control signal FR is "0", it outputs V34 (10V).

In this case, V0, V21 and V34 are voltages supplied from the outside to the driver and it is necessary to meet the restriction of V0≧V21≧V34≧GND.

FIG. 10B illustrates the relationship between an input signal and an output voltage in the common mode of the passive matrix driver IC with a mode selection function illustrated in FIG. 9.

As illustrated in FIG. 10B, if the display apparatus drive signal /DSPOF is "high (HIGH: 1)", the driver in a common mode outputs according to a data latch signal and if the display apparatus drive signal /DSPOF is "low (LOW: 0)", the output becomes a predetermined value V5 (for example, GND). If the data latch signal is "1" and also the polarity control signal FR is "1", it outputs V5 (GND) and if the data latch signal is "1" and the polarity control signal FR is "0", it outputs V0 (20V). If the data latch signal is "0" and the polarity control signal FR is "1", it outputs V21 (15V) and if the data latch signal is "0" and the polarity control signal FR is "0", it outputs V34 (5V). V0, V21 and V34 are voltages supplied from the outside to the driver and it is necessary to meet the restriction of V0≧V21≧V34≧GND.

Figure 11:
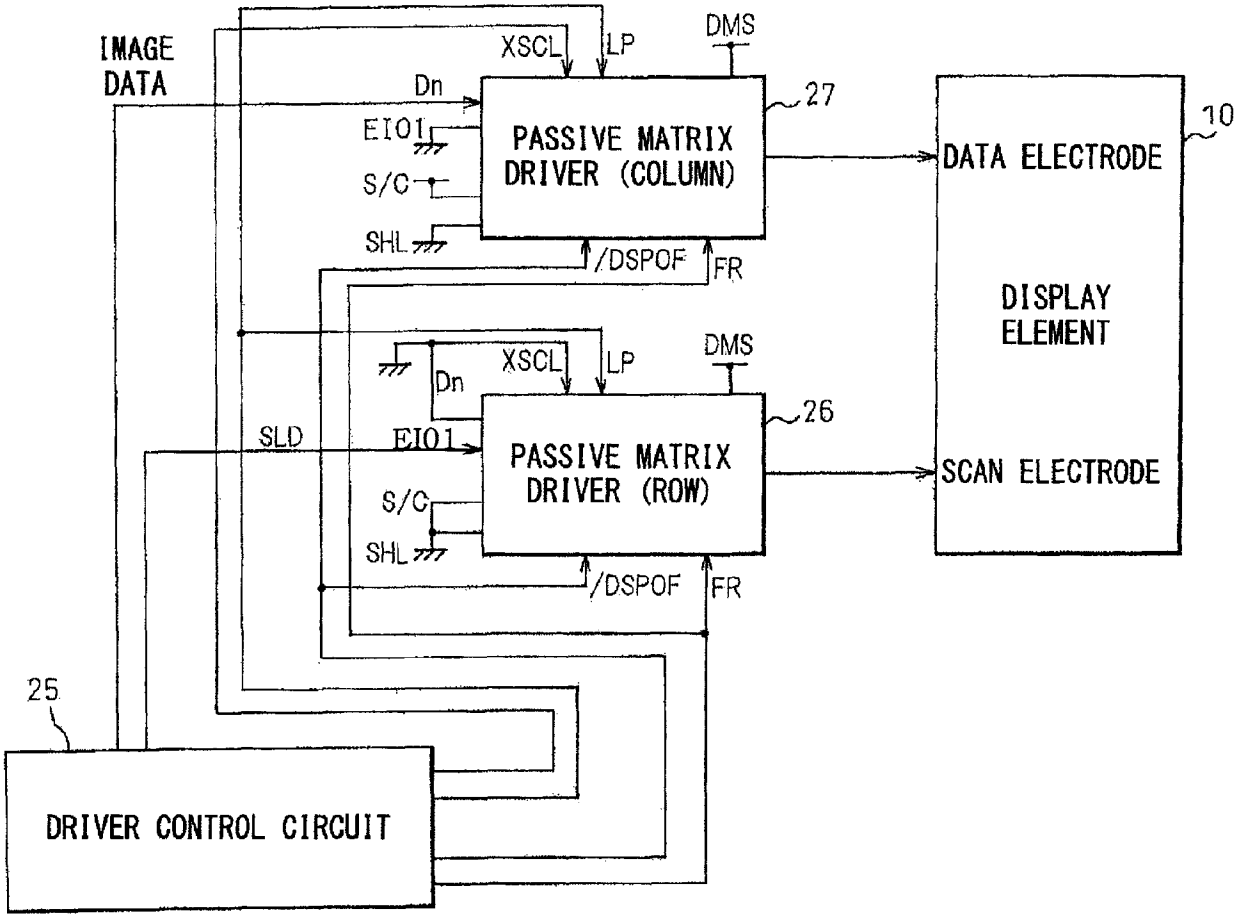
FIG. 11 is a rough configuration of a conventional display using a general-purpose passive matrix driver.

FIG. 11 is a block diagram illustrating the configuration of the display apparatus composed of the passive matrix driver IC with a mode selection function illustrated in FIG. 9. However, FIG. 11 illustrates only the display element 10, the driver control circuit 25, the row driver 26 composed of a passive matrix driver and the column driver 27 composed of a passive matrix driver, and the others are omitted in FIG. 11.

As illustrated in FIG. 11, the mode selection terminal S/C of the row driver 26 is connected to GND and also the row driver 26 is set to a common mode. The mode selection terminal S/C of the column driver 27 is connected to a HIGH terminal and also the column driver 27 is set to a segment mode. The pulse polarity control signal FR and the display apparatus drive signal /DSPOF are commonly inputted to the two drivers. The shift clock of image data and a data confirmation latch pulse are inputted to the XSCL and LP terminals, respectively, of the column driver 27. This data confirmation latch pulse is also inputted to the LP terminal of the row driver 26 and functions as a line shift clock. Image data is inputted to the data input terminals (D0-D7 in the case of 8-bit input) of the column driver 27. Scan line data SLD is inputted to the enable terminal EI01 of the row driver 26. In the normal scan operation, the SLD becomes 1 at the time of start and is maintained in 0 after that (the explanations of other terminals are omitted). Since each control signal is basically the same as that illustrated in FIG. 7, its detailed explanation is omitted.

Figure 13:
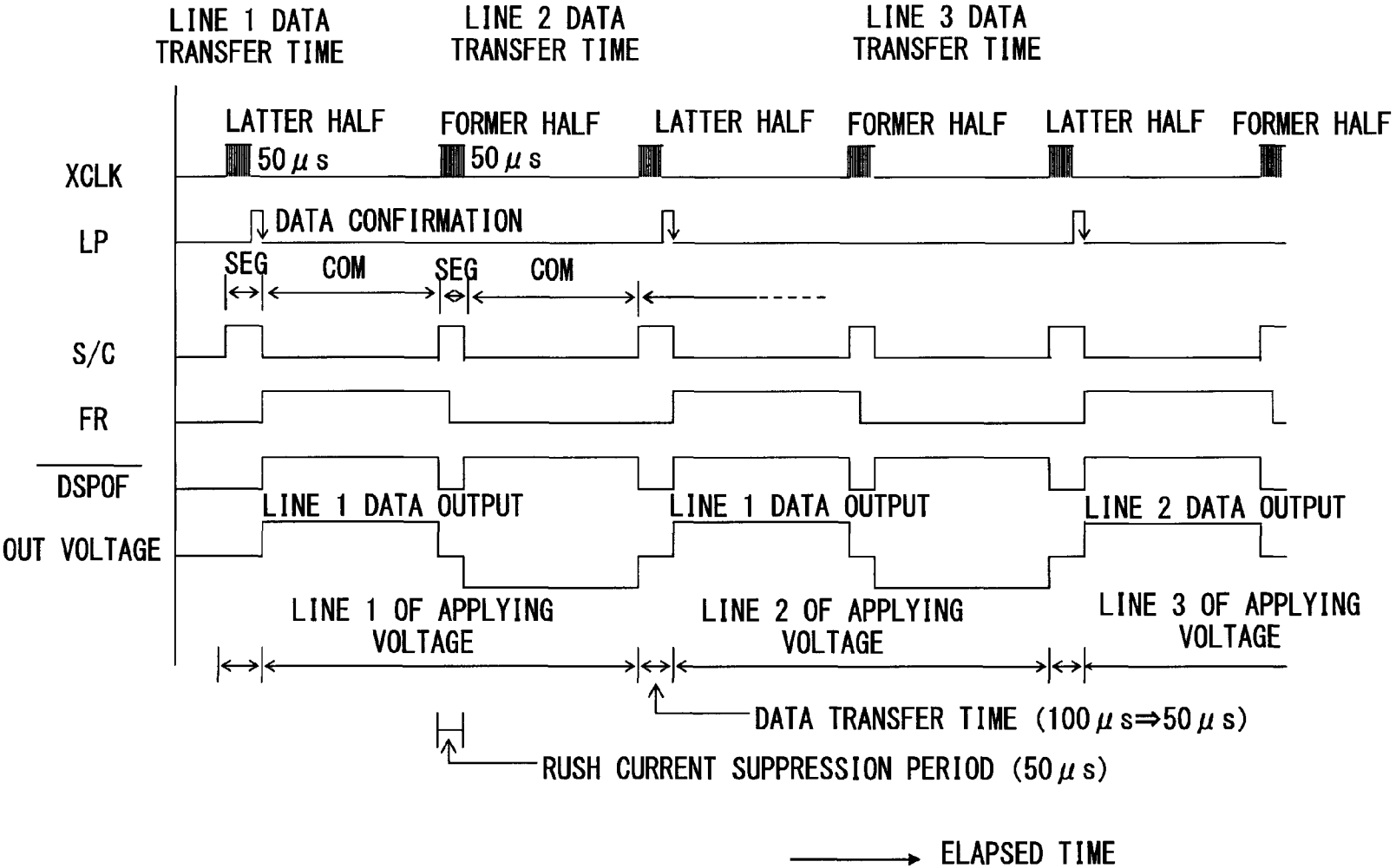
FIG. 13 is a time chart illustrating the sequence of the output signal of the passive matrix driver provided for a display apparatus according to the embodiment of the present invention.

FIG. 13 is a time chart illustrating the output signal sequence of the passive matrix driver provided for a display apparatus according to the embodiment of the present invention.

Figure 12:
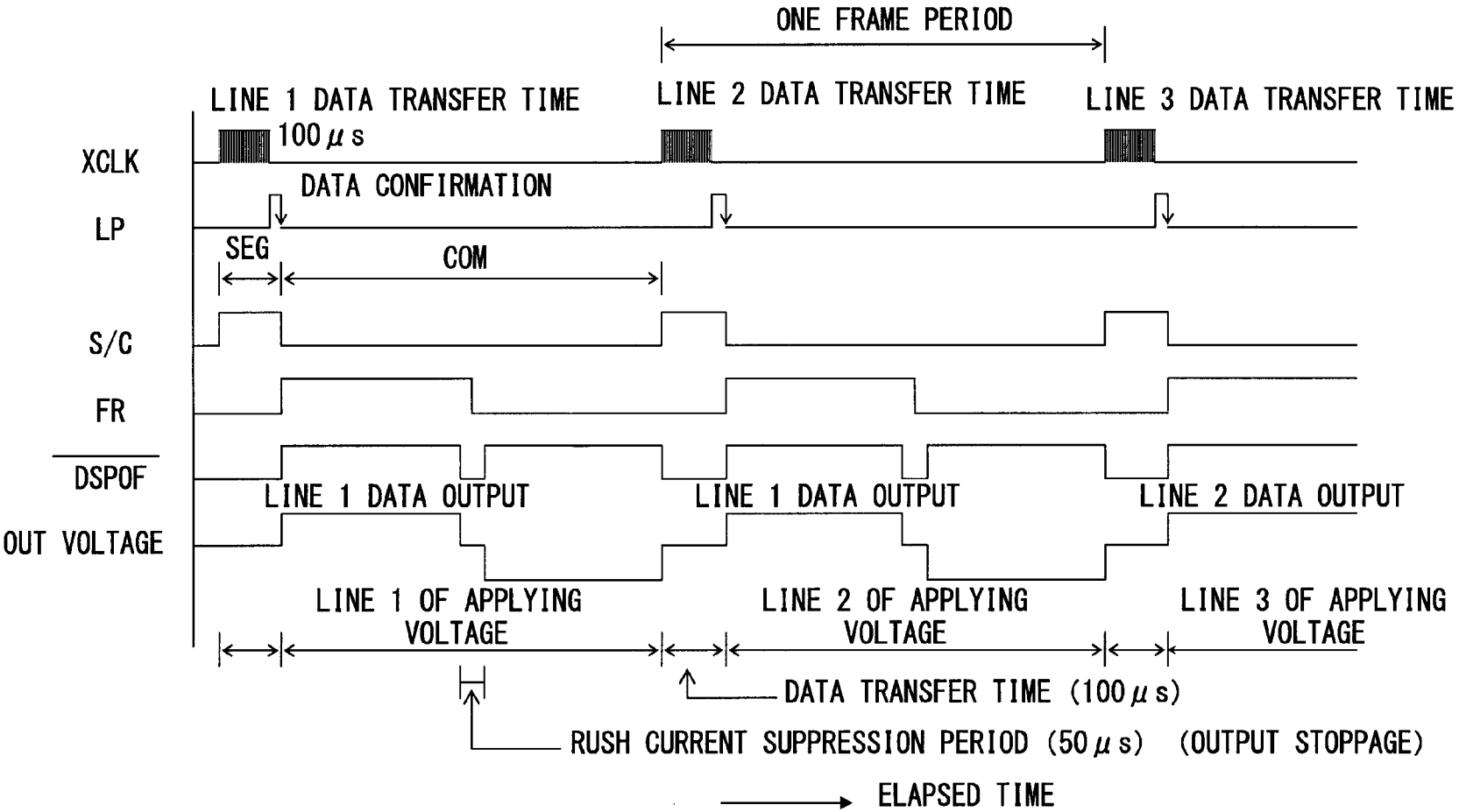
FIG. 12 is a time chart illustrating the sequence of the output signal of a general passive matrix driver.

In FIG. 13, a pulse signal XCLK is a clock for retrieving data (see FIGS. 6 and 12). A pulse signal LP is a data confirmation latch pulse and a switching signal S/C rising at the line data transfer is a control signal for instructing the switching over between the segment and common modes. A frame signal FR repeating cyclic rise and fall is a pulse polarity control signal for recovering time-varying degradation peculiar to liquid crystal by inverting the polarity of an applied voltage. A display apparatus drive signal /DSPOF (DSPOF bar, the same signal as the /DSPOF illustrated in FIG. 6) is the drive signal of a liquid crystal display apparatus and more particularly it is the inverse signal of the compulsory off signal of an applied voltage (signal for switching off an applied voltage, that is, signal DSPOF) (see FIG. 12). Furthermore, an OUT voltage is applied to the liquid crystal in order to display (output) line data.

As illustrated in FIG. 13, the sequence of the output signals of a passive matrix driver provided for the display apparatus according to this embodiment, that is, the pulse signal LP being a data confirmation latch pulse and the frame signal FR being a pulse polarity control signal, the display apparatus driving signal /DSPOF (DSPOF bar) and the OUT voltage applied to the liquid crystal in order to display (output) line data is the same as the sequence of the output signals of a general passive matrix driver.

However, in the output signal sequence of the passive matrix driver according to this embodiment illustrated in FIG. 13, the switching signal S/C for instructing the switching over between the segment and common modes is switched over to the common mode at the falling time of the display apparatus driving signal /DSPOF (DSPOF bar) for preventing rush current from occurring at the falling time of the frame signal FR for inverting the polarity of an applied voltage too, and transfers the former half of one line of data. At this moment, the driver outputs a pulse signal XCLK and retrieves the data. This falling period of the display apparatus driving signal /DSPOF (DSPOF bar) for preventing rush current from occurring at the falling time of the frame signal FR for inverting the polarity of an applied voltage is a period during which the switching signal S/C is in the common mode in the conventional control sequence, that is, a period during which the data output of the driver is compulsorily stopped since it is in the common mode. However, since during this period the display apparatus driving signal /DSPOF (DSPOF bar) is made to fall and the data output of the driver is compulsorily stopped, the switching signal S/C can be switched over to the segment mode and in the period in which the driver is not used to transfer data in the common mode, the former half of line data can be outputted. Therefore, in the conventional line data transfer period (essential line data transfer period), only the latter half of the line data can be transferred and outputted. The present invention is made based on paying attention to this point. Thus, the falling period of the display apparatus driving signal /DSPOF (DSPOF bar) can be shortened to the half of conventional one and a time during which the liquid crystal does not operate can be shortened, thus improving the response characteristics of the liquid crystal.

Figure 14:
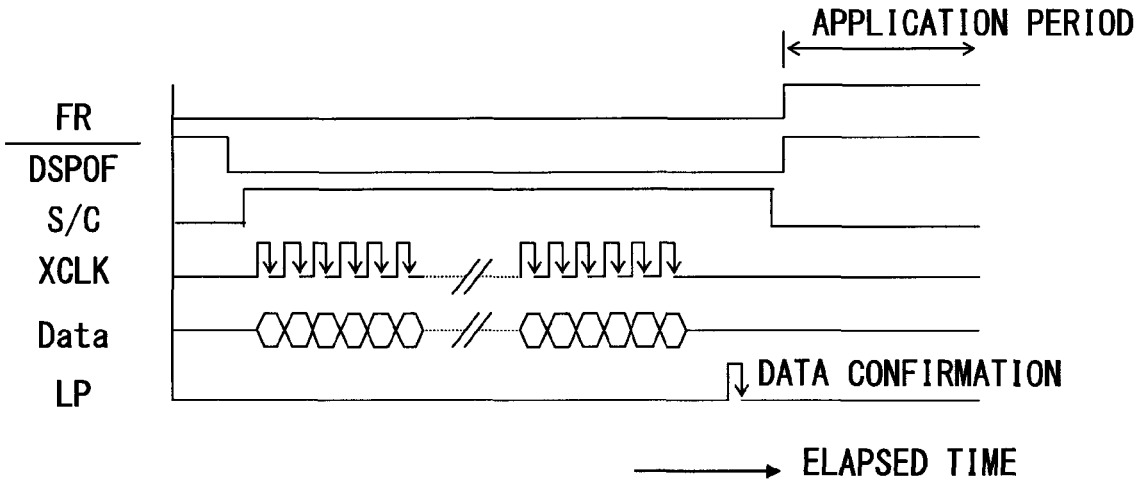
FIG. 14 is a time chart illustrating the sequence of the output signal during the data transfer period of the passive matrix driver of a display apparatus according to the embodiment of the present invention.

FIG. 14 is a time chart illustrating the of the output signal sequence during the data transfer period of the passive matrix driver of a display apparatus according to the embodiment of the present invention.

As illustrated in FIG. 14, the passive matrix driver of a display apparatus according to this embodiment makes the display apparatus driving signal /DSPOF (DSPOF bar) illustrated in FIG. 13 to fall during the data transfer period. Then, it makes the switching signal S/C rise by switching over the switching signal S/C and switches over to the segment mode. Simultaneously, it outputs a pulse signal XCLK as a data retrieving clock and outputs "Data" being display data. After completion of these outputs, it outputs the pulse signal LP indicating a data confirmation latch pulse and the display data (Data) is retrieved. Lastly, an OUT voltage (FIG. 13) for outputting (displaying) line data is applied to the liquid crystal and the data is displayed.

Figure 15:
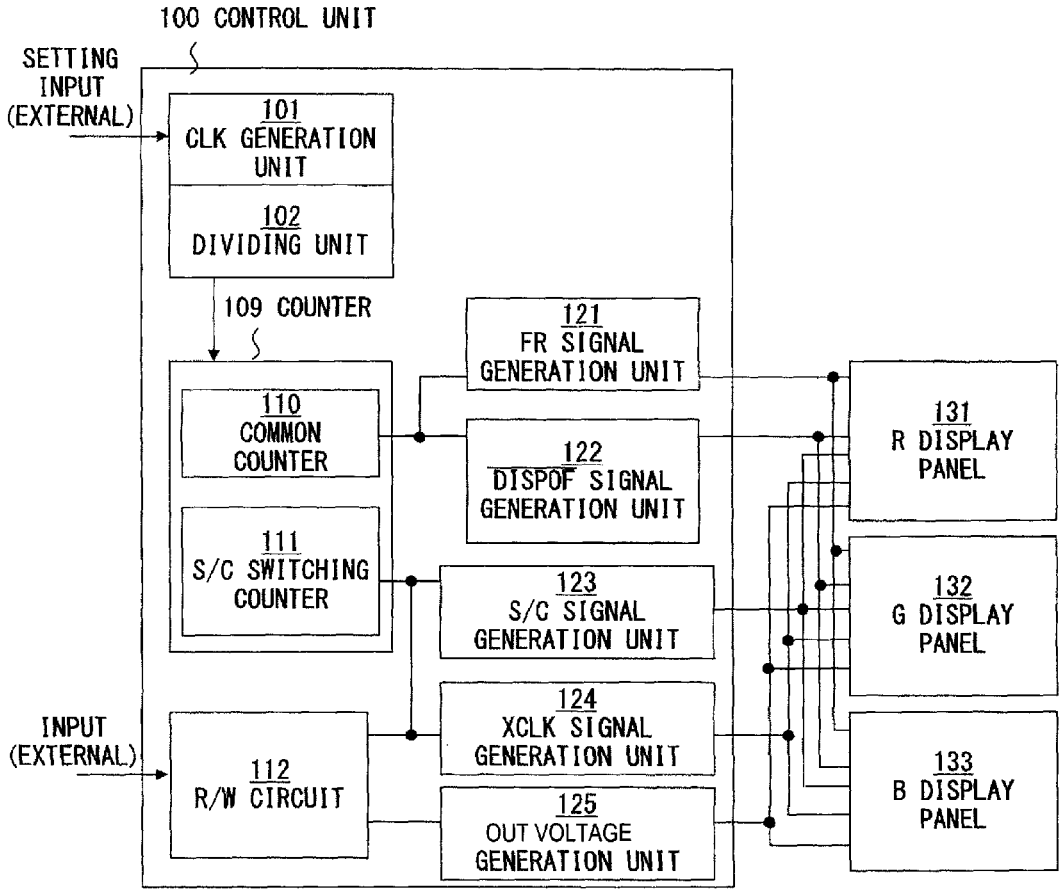
FIG. 15 is a block configuration from the functional point of view, of the driver control circuit 25 provided for a display apparatus according to the embodiment of the present invention.

FIG. 15 is a block configuration from the functional point of view, of the driver control circuit 25 provided for the display apparatus according to the embodiment of the present invention.

In FIG. 15, a control unit 100 is a functional block of the driver control circuit 25 provided for the display apparatus according to this embodiment.

The control unit 100 includes a CLK (clock) generation unit 101 for generating a pulse signal CLK, a dividing unit 102 for dividing the pulse signal CLK and a counter 109 including a common counter 110 and an S/C switching counter 111 and also counting sequence control timing on the basis of the output pulse of the dividing unit 102.

The counter 109 of the control unit 100 includes a common counter 110 for counting timing necessary for control sequence and an S/C switching counter 111 for switching the S/C signal (FIG. 13).

Furthermore, the control unit 100 includes an R/W circuit 112 for outputting a signal indicating the generation timing of a signal XCLK (FIG. 13) and also a signal indicating the application timing of the OUT voltage (FIG. 13), an FR signal generation unit 121 for generating the FR signal (FIG. 13), an /DISPOF signal generation unit 122 for generating a signal /DISPOF (the same signal as the signal /DSPOF illustrated in FIG. 13), an S/C signal generation unit 123 for generating the signal S/C (FIG. 13), an XCLK signal generation unit 124 for generating the signal XCLK (FIG. 13) and an OUT voltage generation unit 125 for generating the OUT voltage (FIG. 13).

The operation of the control unit 100 will be explained below.

The CLK (clock) generation unit 101 generates the pulse signal CLK (FIG. 13) capable of setting a cycle by an external input. The dividing unit 102 receives the clock from the CLK (clock) generation unit 101 and divides it into clocks necessary for sequence control. The clocks outputted by the dividing unit 102 are transmitted to the counter 109 for outputting the generation timing of control signals necessary for sequence control.

The common counter 110 of the counter 109 receives the clock of the dividing unit 102, counts timing necessary for control sequence and transmits a signal for reporting this timing to both the FR signal generation unit 121 for generating the signal FR (FIG. 13) and the /DISPOF signal generation unit 122 for generating the signal /DISPOF (FIG. 13). The signal for reporting the timing is also transmitted to the S/C switching counter 111. Then, the S/C switching counter 111 outputs a signal for instructing the switching signal S/C (FIG. 13) to enter the segment mode while the signal /DISPOF is falling and to enter the common mode while the signal /DISPOF is rising, and transmits it to the S/C signal generation unit 123.

The R/W circuit 112 receives a data signal inputted from the outside, detects the application timing and stoppage timing of the OUT voltage (FIG. 13) from this data signal and transmits it to the OUT voltage generation unit 125. The R/W circuit 112 also detects a clock pulse becoming the base of the signal XCLK from this data signal and transmits it to the XCLK signal generation unit 124 and the S/C signal generation unit 123.

The FR signal generation unit 121 receives the output (timing) of the common counter 110, generates the signal FR (FIG. 13) and transmits it to the display panels (more particularly, an R display panel 131, a G display panel 132 and a B display panel).

The /DISPOF signal generation unit 122 receives the output (timing) of the common counter 110 similarly, generates the signal /DISPOF (the same signal as the /DSPOF illustrated in FIG. 13) and transmits it to the display panels.

The S/C signal generation unit 123 receives each of the outputs of the S/C switching counter 111 and the R/W circuit 112, generates the signal S/C (FIG. 13) and transmits it to the display panels. The XCLK signal generation unit 124 receives a basic signal of the signal XCLK (FIG. 13) detected by the R/W circuit 112, outputs a signal XCLK and transmits it the display panels. Furthermore, the OUT voltage generation unit 125 receives the application timing of the OUT voltage (FIG. 13) from the R/W circuit 112, generates an OUT voltage and applies it to the display panels.

Since this embodiment has such a configuration, the falling period of the display apparatus driving signal /DSPOF (DSPOF bar) in the conventional data transfer period can be shortened to approximately the half. Thus, since a time during which the liquid crystal does not operate is reduced, the response characteristics of the liquid crystal can be surely improved.

The invention claimed is:

1. A display apparatus provided with a matrix display element, a row driver for driving a scan electrode of the display element, a column driver for driving a data electrode of the display element, comprising:

a unit for outputting one set of control signals composed of a pulse signal XCLK being a clock for retrieving data, a pulse signal LP being a latch pulse for data confirmation, a frame signal FR being a pulse polarity control signal for preventing degradation of liquid crystal and a driving signal /DSPOF specifying a display apparatus driving stoppage period for preventing rush current caused at a falling time of the frame signal FR entering into liquid crystal;

a unit for outputting a switching signal S/C for specifying either a segment mode capable of transferring display data or a common mode for applying a voltage to liquid crystal and outputting the transferred display data;

a unit for switching over to the segment mode capable of transferring display data according to the switching signal S/C during the display apparatus driving stoppage period set by the driving signal /DSPOF; and a unit for transferring part of the display data during the period in which a mode is switched over to the segment mode.

2. The display apparatus according to claim 1, wherein part of the display data transferred during a period in which a mode is switched over to the segment mode is a former half of the display data.

3. The display apparatus according to claim 1, wherein all of the control signal, switching signal S/C and an output signal of the display data are inputted to a liquid crystal panel supporting full-color display.

4. The display apparatus according to claim 3, wherein the liquid crystal display panel supporting full-color display is composed of three layers of liquid crystal panels corresponding to red, green and blue colors.

* * * * *